US005832940A

United States Patent [19]

Embry et al.

[11] Patent Number: 5,832,940

[45] Date of Patent: Nov. 10, 1998

[54] SELF-CONTAINED TOOTHBRUSH CONSTRUCTION

[76] Inventors: Darryl Embry; Regina Embry, both of 364 Cardinal Dr., Campbellsburg, Ky. 40011

[21] Appl. No.: 941,007

[22] Filed: Sep. 30, 1997

[51] Int. Cl.[6] ..... A45D 44/18

[52] U.S. Cl. ..... 132/309; 132/308; 132/312; 132/311

[58] Field of Search ..... 132/308, 309, 132/311, 312, 313, 315, 314; 401/39, 183, 269, 281, 287; 206/218, 361; 220/8

[56] References Cited

U.S. PATENT DOCUMENTS 3,847,168 11/1974 Schlegel ..... 132/92 R
4,919,156 4/1990 Gipson ..... 132/309
5,215,193 6/1993 Dennis ..... 206/223
5,228,466 7/1993 Klinkhammer ..... 132/308

*Primary Examiner*—Gene Mancene
*Assistant Examiner*—Philogene Pedro
*Attorney, Agent, or Firm*—Henderson & Sturm

[57] ABSTRACT

A self-contained toothbrush construction 10 including a handle member 20 forming a receptacle for dentifrice, a brush member 30 having a hollow handle portion 32 defining a internal passageway 31 in open communication with the handle member 20 and a collapsible cover unit 13 including a plurality of telescoping cover segments 51 wherein one of the cover segments 56 forms a compartment 57 for dental floss 60 and another cover segment 52 is provided with a plurality of apertures 54 controlled by a hinged lid element 55.

10 Claims, 2 Drawing Sheets

SELF-CONTAINED TOOTHBRUSH CONSTRUCTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable

BACKGROUND OF THE INVENTION

1. Field of the Invention

The present invention relates to the field of toothbrush constructions in general, and in particular to a self-contained toothbrush construction wherein the toothbrush is provided with a supply of dentifrice.

2. Description of Related Art

As can be seen by reference to the following U.S. Pat. Nos. 3,847,168; 4,919,156; 5,215,193; and 5,228,446, the prior art is replete with myriad and diverse dental hygiene implements.

While all of the aforementioned prior art constructions are more than adequate for the basic purpose and function for which they have been specifically designed, they are uniformly deficient with respect to their failure to provide a simple, efficient, and practical self-contained toothbrush construction that has a plurality of cooperating components that will interact with one another in a variety of different ways.

As anyone who has used a self-contained toothbrush is well aware, the toothbrush head bearing component has a limited useful life and should be replaced on a regular basis.

As a consequence of the foregoing situation, there has existed a longstanding need for a new and improved self-contained toothbrush construction that provides both for a replaceable brush unit and also a collapsible cover unit that will preserve the toothpaste supply when the brush unit is not in place and the provision of such a construction is a stated objective of the present invention.

BRIEF SUMMARY OF THE INVENTION

Briefly stated, the self-contained toothbrush construction that forms the basis of the present invention comprises in general, a handle unit, a replaceable brush unit, and a collapsible cover unit that cooperate with one another in a new, unique and novel fashion.

As will be explained in greater detail further on in the specification, the handle unit defines a receptacle for a supply of dentifrice such as toothpaste or the like. One end of the handle unit is threaded to accept both the cover unit and the brush unit.

In addition, the brush unit is provided with an internal passageway that extends from the brush head through the stem portion of the brush unit wherein the hollow stem portion is further provided with a tubular extension having a discrete cap closure element to prevent dentifrice within the internal passageway from drying out.

Furthermore, the collapsible cover unit comprises a plurality of telescoping cover segments wherein one cover segment defines a dental floss compartment. Another cover segment is provided with air circulating apertures controlled by a hinged lid element and all of the cover segments cooperate with one another to form a compact closure element when the brush unit is not deployed on the handle unit.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
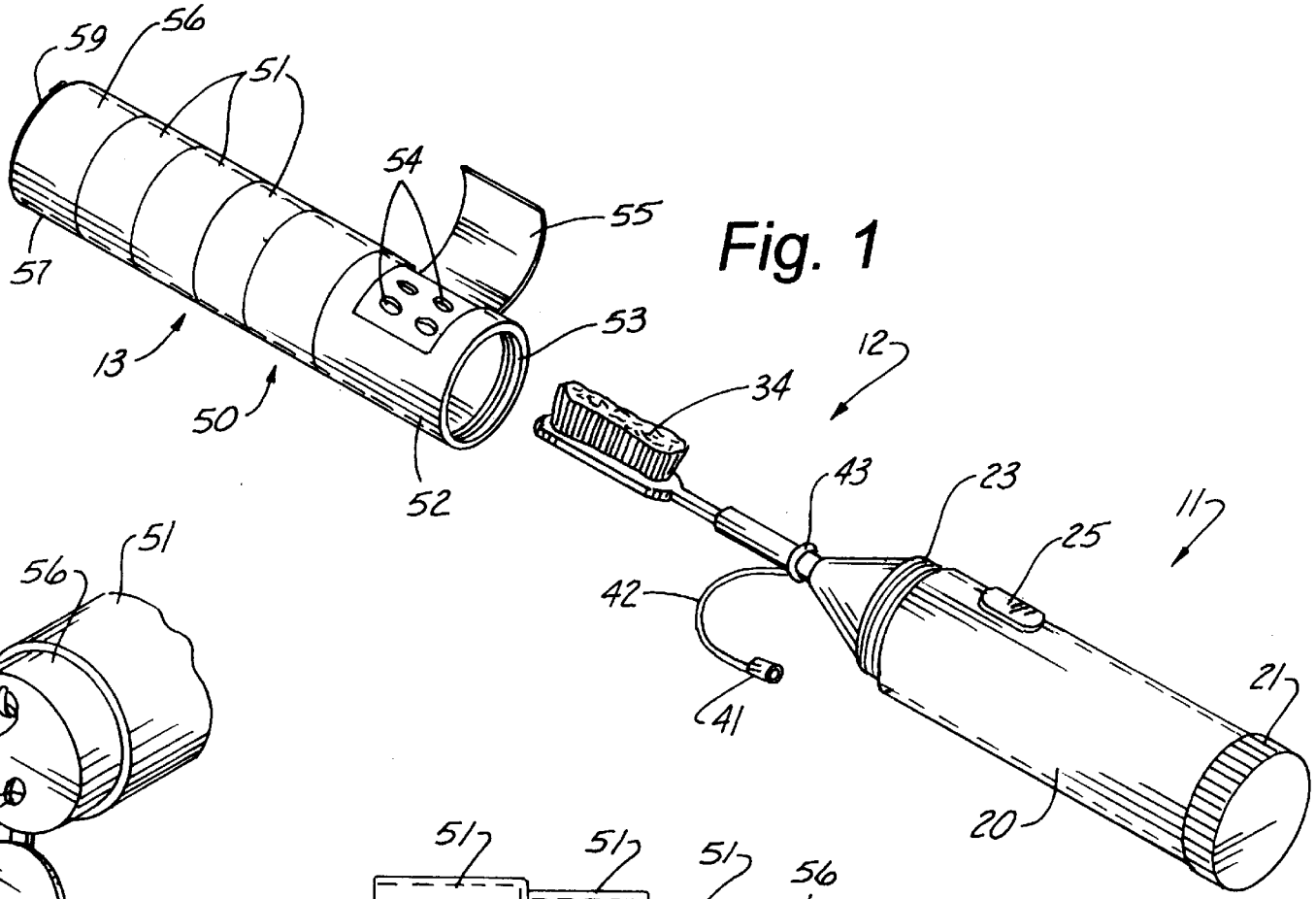
FIG. 1 is a partially exploded perspective view of the self-contained toothbrush construction that forms the basis of the present invention.

As can be seen by reference to the drawings, and in particularly to FIG. 1, the self-contained toothbrush construction that forms the basis of the present invention is designated generally by the reference number 10. The construction 10 comprises in general, a handle unit 11, a replaceable brush unit 12 and a collapsible cover unit 13. These units will now be described in seriatim fashion.

Figure 4:
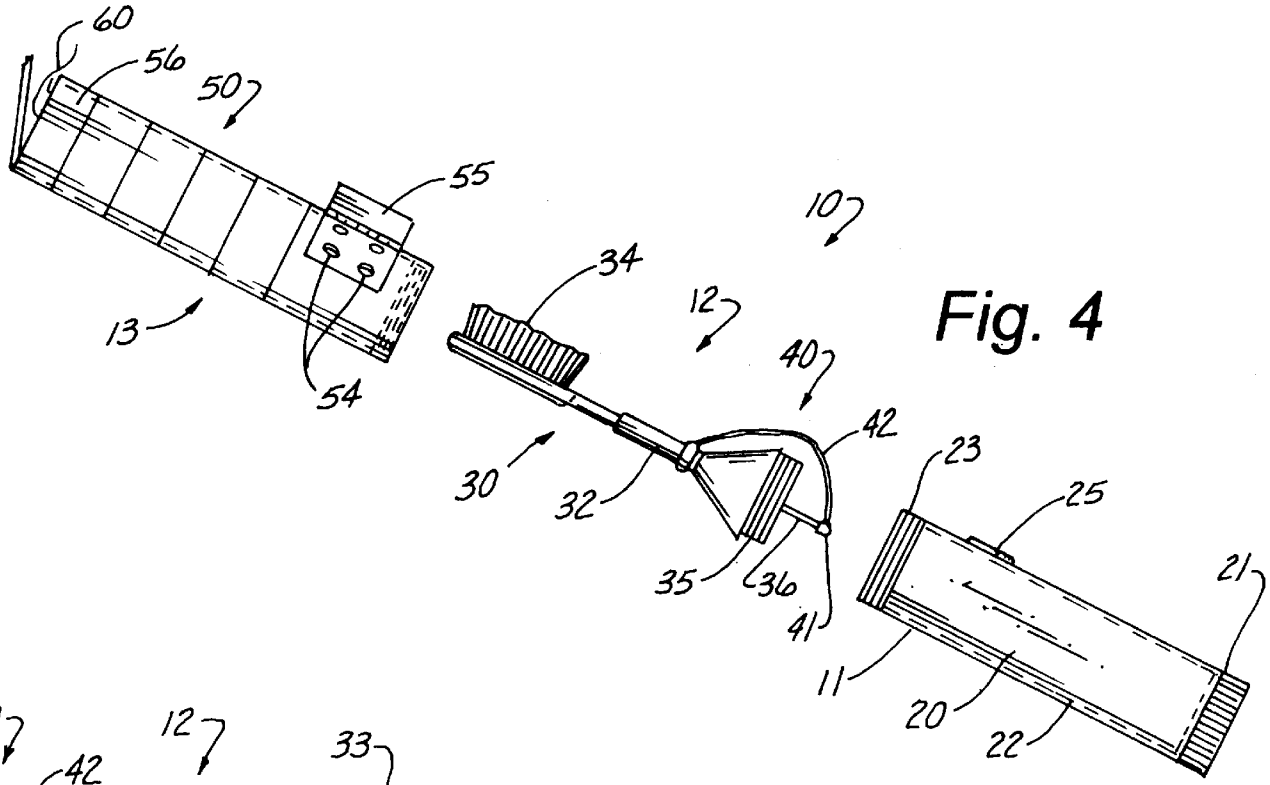
FIG. 4 is an exploded perspective view of the primary components of the toothbrush construction.

As shown in FIGS. 1 and 4, the handle unit 11 comprises in general an elongated hollow cylindrical handle member 20 having a removable closure element 21 formed on one end, wherein the interior of the handle member 20 defines a reservoir 22 for dentifrice such as toothpaste or the like.

In addition, the other end of the hollow handle member 20 is provided with both internal and external threading 23 whose purpose and function will be described presently. The handle member 20 is also provided with a conventional push button actuated dispensing means 25 which will force the dentifrice within the reservoir 22 in the direction of the threaded end 23 in a well recognized manner.

Figure 5:
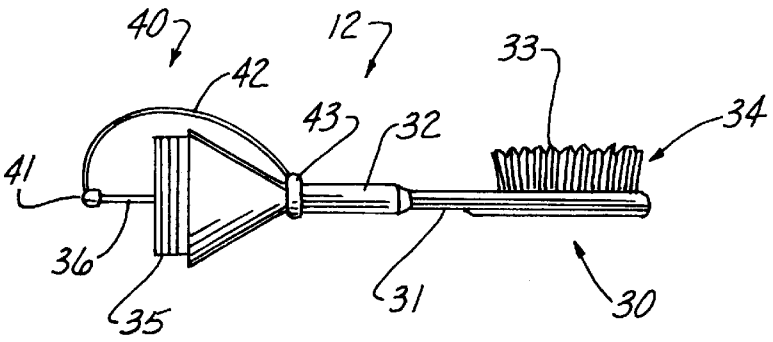
FIG. 5 is an isolated detail view of the brush unit.

As can best be seen by reference to FIGS. 1, 4, and 5, the brush unit 12 comprises a hollow brush member 30 having an internal passageway 31 in a stem portion 32 in open fluid communication with the bristles 33 of the brush head 34. The inboard end of the hollow stem portion 32 is threaded as at 35 and provided with a tubular extension 36 whose purpose and function will be described presently.

In addition, as shown in FIG. 5, the brush unit 12 also includes a closure element 40 which includes a discrete cap element 41 disposed on a flexible tether 42 which is operatively connected to a collar 43 disposed in a surrounding relationship with the hollow stem portion 32 of the brush member 30. The cap element 41 is dimensioned to sealingly engage the end of the tubular extension 36 when the brush unit 12 is not attached to the handle unit 11.

Turning now to FIGS. 1 through 4, it can be seen that the collapsible cover unit 13 comprises in general a collapsible cover member 50 having a plurality of telescoping cover segments 51 wherein the inboard or largest cover segment 52 is internally threaded as at 53, and provided with a plurality of apertures 54 which are controlled by a hinged lid 55.

In addition, the outboard or smallest cover segment 56 defines a dental floss compartment 57 having a floss dispensing apertured lid element 58 and a hinged cap 59. The hinged cap 59 is uncovered to allow dental floss 60 to be dispensed through the apertured lid element 58 and severed by the tang 61 of the apertured lid element 58 in a well recognized fashion.

Figure 3:
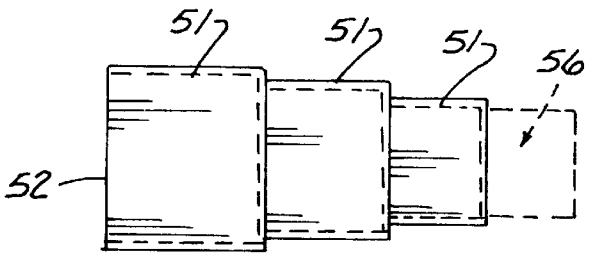
FIG. 3 is a side elevation view of a partially collapsed cover unit.
Figure 2:
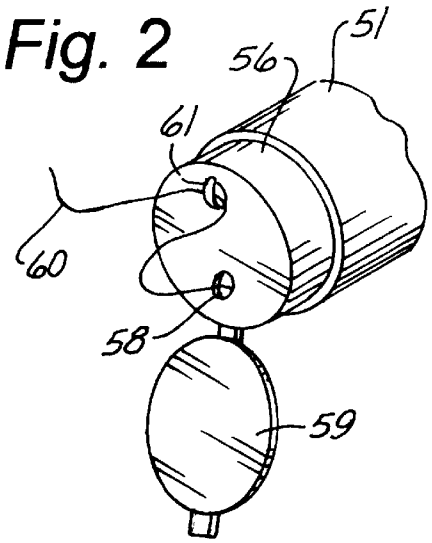
FIG. 2 is a side elevation view of a partially collapsed cover unit.

As can best be seen by reference to FIG. 3, the collapsible cover member 50 is designed such that the smaller telescoping cover segments 51 can all be received inside the largest cover segment 52 when the brush unit 12 is not operatively deployed on the handle unit 11. In this particular mode of disposition, the inboard ends of the smaller cover segments 51 and the dental floss compartment 57 are disposed in closed proximity to the open end of the handle member 20 such that the cover unit 13 forms a tight seal over the dentifrice in the handle unit 11. This feature will prevent the dentifrice from drying out and hardening into an unflowable mass when the brush unit 12 is not attached thereto.

Furthermore, as shown in FIG. 5, when the brush unit 12 is not deployed on the handle unit 11 the cap element 41 is disposed on the end of the tubular extension 36 on the brush unit 12 to prevent any dentifrice in the tubular extension 36 and the internal passageway 31 in the hollow stem portion 32 of the brush member 30 from drying up for the same reasons.

Turning now to FIG. 1, it can be seen that when the brush member 30 is operatively deployed on the handle member 20, the collapsible cover unit 13 is fully extended to accommodate the length of the brush member 30, the hinged flap 55 on the cover member 50 may be opened to allow air to circulate through the apertures 54 in the largest cover segment 52 so that the bristles 33 on the brush head 34 can dry out. Then once the bristles 33 are dry, the hinged flap 55 would be reengaged to prevent the surface of the bristles 33 from being contaminated by contact with elements present around the exterior of the cover member 50.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

We claim:

1. A self-contained toothbrush construction comprising:

a handle unit including a hollow handle member defining a receptacle for dentifrice and having internal and external threads disposed on one end;

a brush unit including a brush member having one end threadedly engageable with the internal threads on the handle member; and a cover unit including a collapsible cover member comprising a plurality of telescoping cover segments wherein one of the cover segments has one end threadedly engageable with the external threads on the handle member.

2. The construction as in claim 1 wherein said plurality of telescoping cover segments diminish in size from the largest cover segment to the smallest cover segment.

3. The construction as in claim 2 wherein a selected one of said plurality of cover segments is provided with a plurality of apertures.

4. The construction as in claim 3 wherein said selected one of said plurality of cover segments is further provided with a hinged lid element that is dimensioned to overlie said plurality of apertures.

5. The construction as in claim 2 wherein said smallest cover segment defines a compartment dimensioned to receive a quantity of dental floss.

6. The construction as in claim 5 wherein said smallest cover segment is provided with a dental floss dispensing apertured lid element.

7. The construction as in claim 6 wherein said smallest cover segment is further provided with a hinged cap that covers the apertured lid element.

8. The construction as in claim 1 wherein said brush member comprises a brush head, a stem portion having an internal passageway and a tubular extension of the internal passageway extending beyond the threaded end of the brush member.

9. The construction as in claim 8 wherein the brush unit further includes a closure element comprising a cap element captively associated with the stem portion of the brush member and dimensioned to engage one end of said tubular extension.

10. The construction as in claim 9 wherein said cap element is disposed on one end of a flexible tether wherein the other end of the flexible tether is connected to a collar disposed in a surrounding relationship relative to the stem portion of the brush member.

* * * * *